US006823677B2

(12) United States Patent
Prociw et al.

(10) Patent No.: US 6,823,677 B2
(45) Date of Patent: Nov. 30, 2004

(54) STRESS RELIEF FEATURE FOR AERATED GAS TURBINE FUEL INJECTOR

(75) Inventors: Lev Alexander Prociw, Elmira (CA); Harris Shafique, Longueuil (CA); Victor Gandza, Bolton (CA)

(73) Assignee: Pratt & Whitney Canada Corp., Longueuil (CA)

( * ) Notice: Subject to any disclaimer, the term of this patent is extended or adjusted under 35 U.S.C. 154(b) by 112 days.

(21) Appl. No.: 10/232,397

(22) Filed: Sep. 3, 2002

(65) Prior Publication Data

US 2004/0040310 A1 Mar. 4, 2004

(51) Int. Cl.[7] ..... F23D 14/48
(52) U.S. Cl. ..... 60/800; 60/740; 239/397.5
(58) Field of Search ..... 60/746, 740, 800; 239/397.5

(56) References Cited

U.S. PATENT DOCUMENTS 2,959,355 A * 11/1960 Houser ..... 239/397.5
3,064,425 A 11/1962 Hayes
3,692,372 A 9/1972 Pineo
4,536,932 A 8/1985 Athey
5,222,357 A * 6/1993 Eddy et al. ..... 60/800
5,255,508 A 10/1993 Davis
5,535,585 A 7/1996 Eichhorn
5,735,463 A * 4/1998 Osada et al. ..... 239/397.5
6,082,113 A 7/2000 Prociw et al.
6,149,075 A 11/2000 Moertle et al.
6,289,676 B1 * 9/2001 Prociw et al. ..... 60/740

FOREIGN PATENT DOCUMENTS

EP 0552477 * 7/1999

* cited by examiner

*Primary Examiner*—Michael Koczo
(74) *Attorney, Agent, or Firm*—Ogilvy Renault; Robert Mitchell

(57) ABSTRACT

Thermal stress relief in a nozzle head of a gas turbine fuel nozzle is provided by forming a slit through each selected air passages of the nozzle head. The strategic location of stress-relief slits contributes to extend the fatigue life of the nozzle with minimal cost and impact on the nozzle aerodynamics.

13 Claims, 4 Drawing Sheets

STRESS RELIEF FEATURE FOR AERATED GAS TURBINE FUEL INJECTOR

BACKGROUND OF THE INVENTION

1. Field of the Invention

The present invention generally relates to gas turbine engines, and more particularly, to the relief of thermal stresses in an aerodynamic surface of a gas turbine engine. The present invention is particularly suited for relieving thermal stress in a fuel nozzle of a gas turbine engine combustor.

2. Description of the Prior Art

It is well known to use aerated fuel nozzles for atomizing fuel in a combustion chamber of a gas turbine engine. Such nozzles generally comprise a tubular cylindrical head or outer air swirler defining an array of circumferentially spaced-apart air passages to pass pressurized compressor discharged air at elevated temperatures into the combustion chamber of the engine to atomize the fuel film exiting from the tip of the spray nozzle.

It has been found that such fuel nozzles suffer from low cycle fatigue cracking at the thinnest portion of the webs between the air passages of the nozzle head. This cracking is caused by a thermal gradient existing from the surfaces of the nozzle, which are in contact with the hot pressurized air, to the nozzle core surfaces, which are cooled by the fuel, the temperature of which is less than 200° F. as compared to temperatures as high as 1000° F. for the hot pressurized air flowing through the air passages.

One approach to relieve the stresses in the nozzle head has been to separate the head or outer swirler into two radial components to separate hot from cold material. However, this solution is relatively expensive and increases the number of the pieces composing the spray nozzle tip. Furthermore, it does not provide any means for prolonging the fatigue life of existing one-piece fuel nozzle air swirler.

Therefore, manufacturing of new head components to avoid fatigue cracking due to thermal stresses, as well as reconditioning of operated components for extending the operating life thereof is highly desirable.

SUMMARY OF THE INVENTION

It is therefore an aim of the present invention to provide means for relieving thermal stress in a combustion chamber fuel nozzle of a gas turbine engine with minimum impact to the nozzle aerodynamics.

It is also an aim of the present invention to extend the life of a gas turbine fuel nozzle.

It is a further aim of the present invention to provide a method for improving the fatigue life of a thermally stressed portion of an aerodynamic surface of a gas turbine engine.

Therefore, in accordance with the present invention, there is provided a fuel nozzle for a combustor in a gas turbine engine. The fuel nozzle comprises a fuel nozzle body having a fuel inlet port at one end and a spray tip at the other end for atomizing the fuel. The spray tip includes a nozzle head defining a plurality of air passages for conveying hot pressurized air into the combustor. Each pair of adjacent air passages defines a web. The nozzle head has at least one stress-relief slit which extends through one of the air passages for reducing thermally induced stresses in the webs during operation. The stress-relief slit is sized to substantially prevent air leakage from the air passage.

In accordance with a further general aspect of the present invention, there is provided a method for reducing thermal stresses in a gas turbine engine fuel nozzle of the type having a nozzle head defining an array of air passages, the method comprising the steps of: selecting at least one of the air passages, and defining a stress-relief slit through each selected air passage.

In accordance with a still further general aspect of the present invention, there is provided a method for improving the fatigue life of a gas turbine engine part having an aerodynamic surface defining a fluid flow path, the method comprising the steps of: identifying a first location on said aerodynamic surface which is prone to cracking due to thermal stress, relieving stress from said first location by forming an appropriate number of stress-relief slits in said aerodynamic surface at a second location remote from said first location, said stress-relief slits being sized to substantially prevent fluid leakage from said fluid flow path through said stress-relief slits.

DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
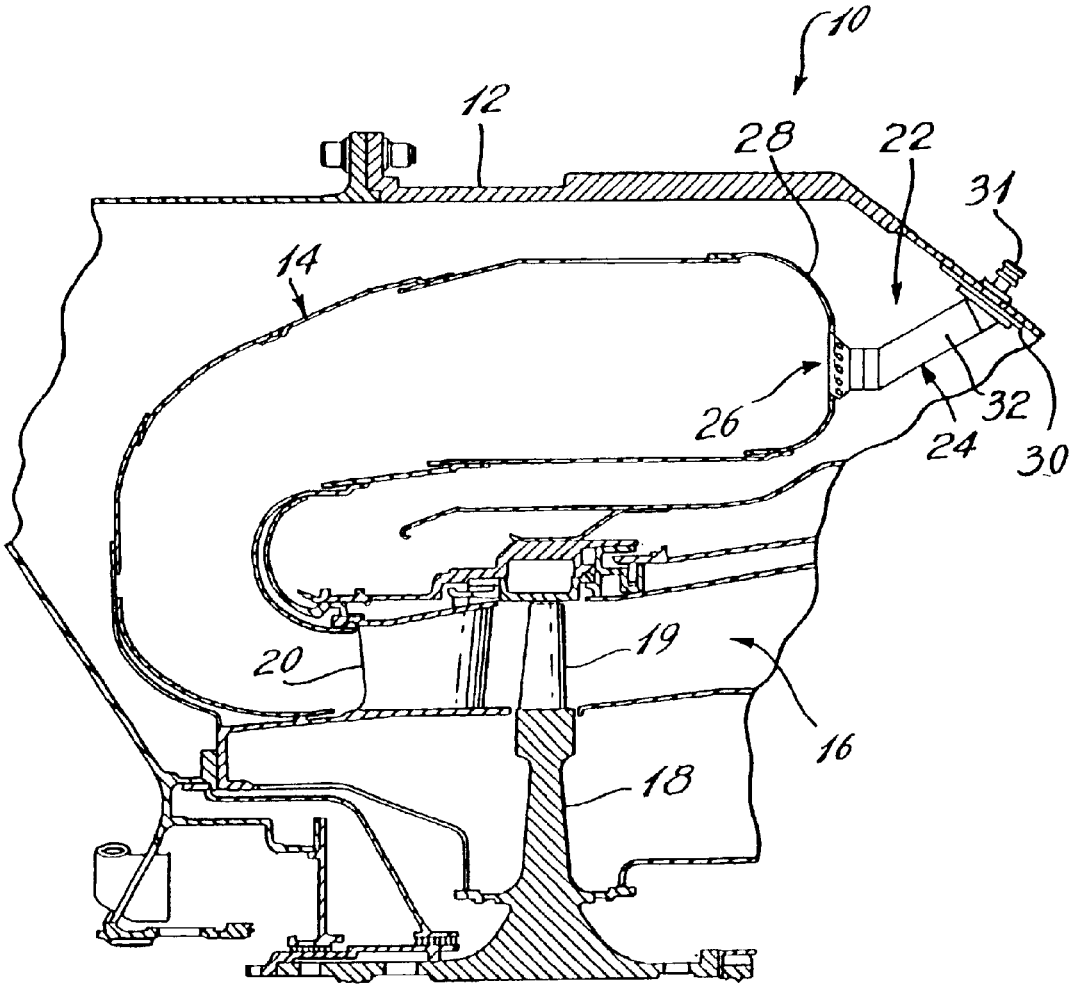
FIG. 1 is a simplified axial cross-section of the combustor of a gas turbine engine which includes the present invention.

Referring now the drawings, FIG. 1 shows a combustor section 10 which includes an annular casing 12 and an annular combustor tube 14 concentric with a turbine section 16. The turbine section 16 is shown with a typical rotor 18 having blades 19 and a stator vane 20 upstream from the blades 19.

An airblast fuel injector or nozzle 22 is shown in FIG. 1 as being located at the end of the annular combustor tube 14 and directed axially thereof. The nozzle 22 is mounted to the casing 12 by means of a bracket 30. The nozzle 22 includes a fitting 31 to be connected to a typical fuel line. There may be several fuel nozzles 22 located on the wall 28 of the combustion chamber, and they may be circumferentially spaced-apart.

The fuel nozzle 22 includes a stem 24 surrounded by a shield 32. The fuel injector 22 also includes a spray tip 26 which is mounted to the combustion chamber wall 28 for spraying or atomizing fuel into the combustion chamber. Only the front face of the tip 26 extends within the combustion chamber while most of the tip 26 is located in the air passage outside wall 28.

Figure 3:
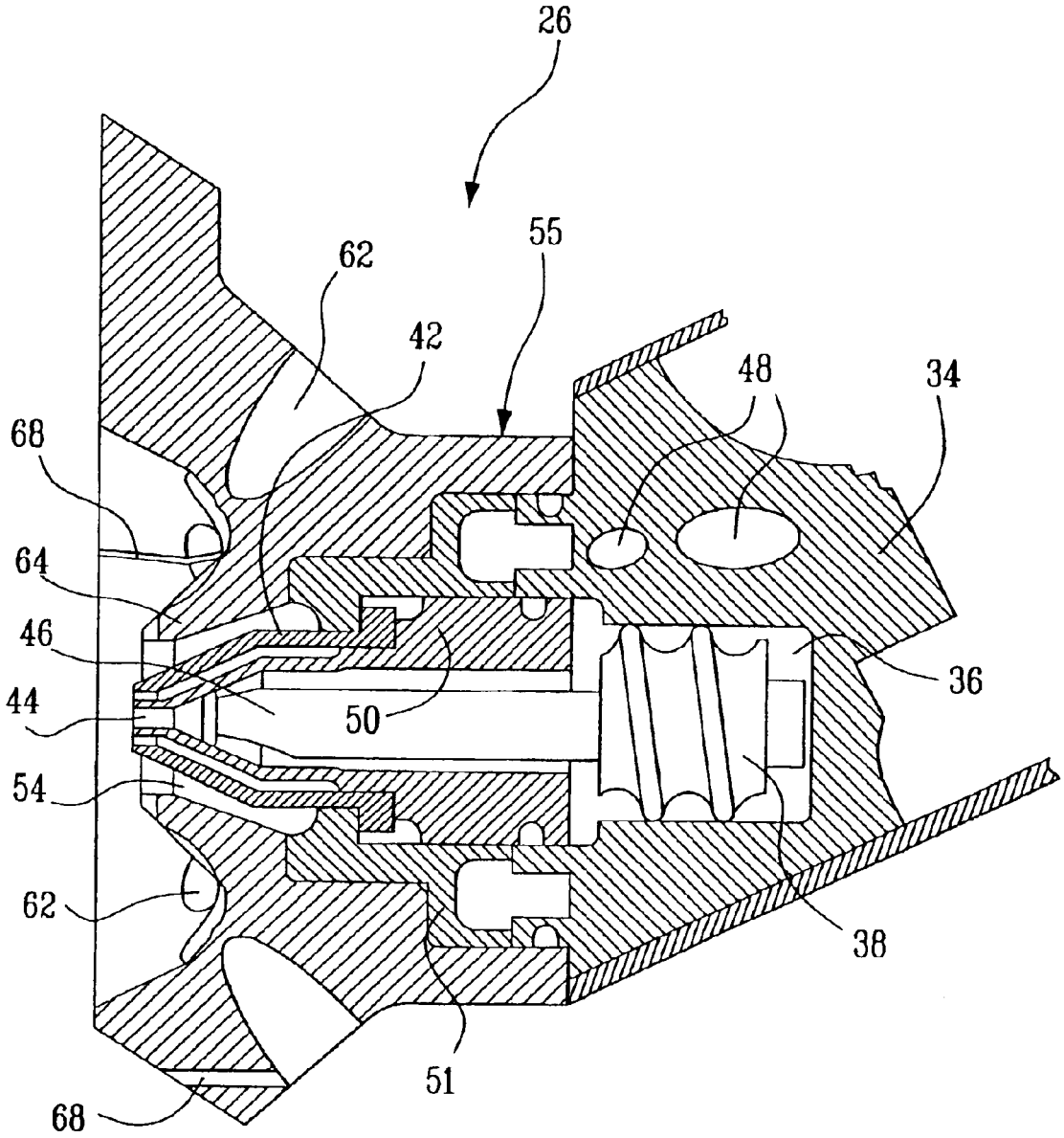
FIG. 3 is a fragmentary, enlarged cross-sectional, axial view of the fuel nozzle shown in FIG. 2.

As shown in FIG. 3, the spray tip 26 includes a machined body 34. An axial recess in the body 34 defines a primary fuel chamber 36. An insert 50 provided within the recess defines the nozzle opening 44 communicating with the fuel chamber 36 for passing the primary fuel. A valving device 38 includes a spiral vane which causes the primary fuel to swirl within the chamber 36. The stem 46 of the valving device 38 acts as metering valve for the primary fuel as it exits through the nozzle opening 44. A shield 42 is fitted onto the insert 50. A second annular insert 51 is mounted to the body 34 concentrically of the insert 50 and forms part of the secondary fuel distribution gallery and nozzle. The secondary fuel passes through somewhat spiral passages making up the fuel gallery 48. The secondary fuel is eventually delivered to an annular fuel nozzle opening 54 which is also a swirler to provide the swirl to the secondary fuel.

Figure 2:
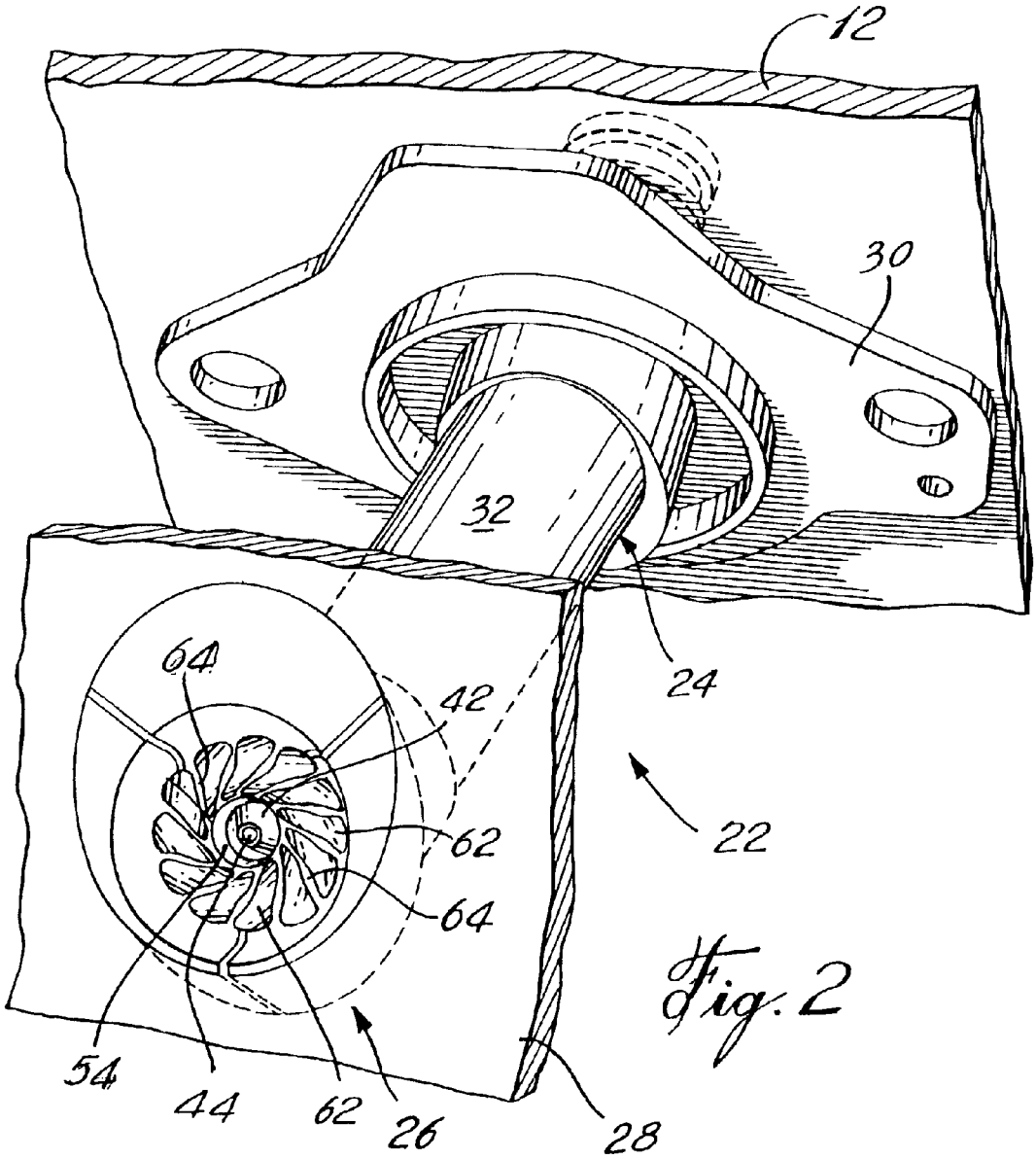
FIG. 2 is an enlarged perspective view of a fuel nozzle incorporating the features of the present invention.
Figure 4:
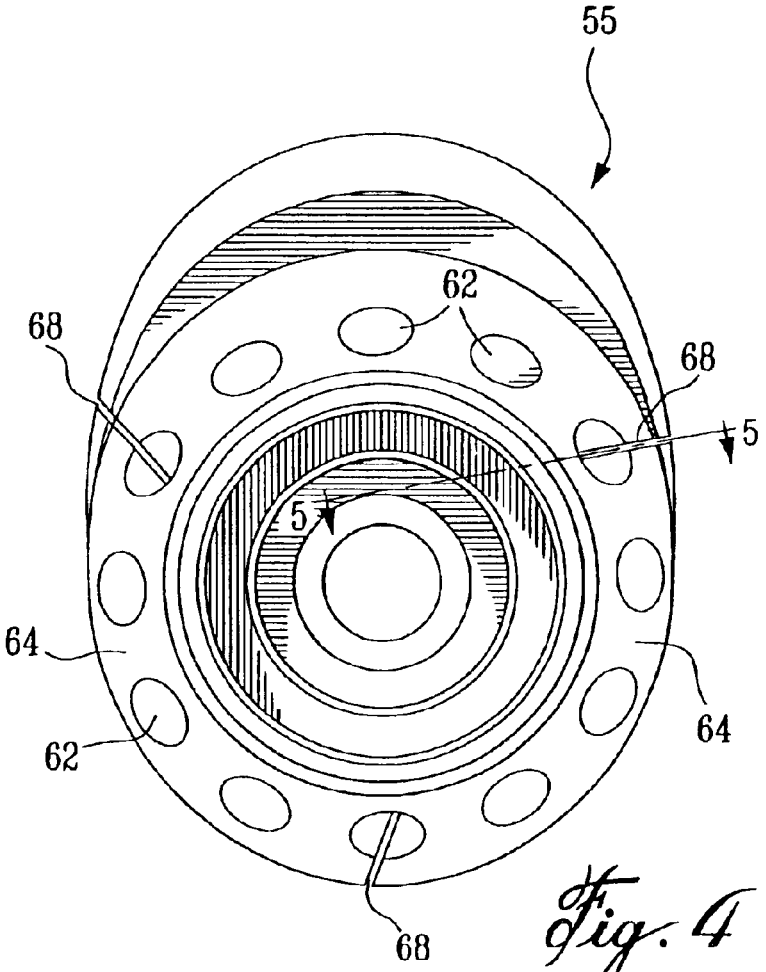
FIG. 4 is a rear elevation of the nozzle head of the fuel nozzle shown in FIG. 2.

The fuel nozzle opening 54 is formed by the insert 51 and a cylindrical tubular head 55 or outer swirler which fits onto the tip body 34 and is concentric with the inserts 50 and 51. As shown in FIGS. 2 to 4, the head 55 defines a row of circumferentially spaced-apart air passages 62, which are adapted to convey pressurized hot air for blending with the primary and secondary fuel sprays issuing from the nozzle openings 44 and 54.

In operation, the air flowing through the air passages 62 can reach up to 1000° F., whereas the temperature of the fuel flowing through the nozzle opening 54 is less than 200° F. This results in severe thermal stresses on the leading edge of the webs 64 between the air passages 62. The gradient of temperature existing across the head 55 is known as the primary source of low cycle fatigue cracking of the head 55. The crack propagation will normally take place at the thinnest portion of the webs 64. To prevent or at least delay the propagation of such thermally induced low cycle fatigue cracking and, thus, extend the fatigue life of the head 55, it is herein proposed to form, as by machining with a cutting or abrasive wheel or by electro discharge machining using a wire, at least one stress-relief slit 68 in the outer periphery of the head with the slit 68 intersecting one of the air passages 62. Surprisingly, it has been found that the formation of such a slit in an aerodynamic part, such as the swirler head 55, has no or very little impact on the swirler aerodynamics, provided the slit is very thin, that is less than 0.006 wide. The slits 68 must be sized so as prevent air leakage from the slotted air passages.

Figure 5:
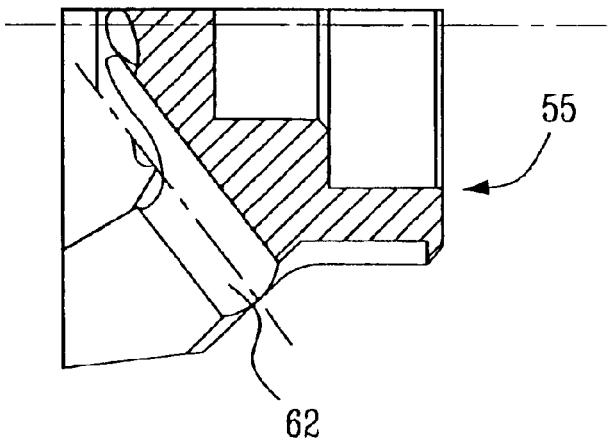
FIG. 5 is a cross-section taken along line 5—5 in FIG. 4.

According to a preferred embodiment of the present invention shown in FIG. 4, three circumferentially spaced-apart stress-relief slits 68 are defined in the outer periphery of the head 55. The slits 68 are strategically sized and located to significantly relieve thermal stresses with minimum impact to the nozzle aerodynamics. The slits are preferably uniformly distributed, that is at 120 degrees from each other. Therefore, in the particular case where there are twelve air passages 62, one stress-relief slit is provided every four air passages. To facilitate the machining thereof, each slit 68 is preferably provided in the form of a straight cut through a selected air passage. Each slit 68 extends through the full thickness of the flanged portion of the head 55 and along the length of the associated air passage (see FIG. 5). The slits 68 can extend radially inwardly in the tubular head 55 or be oriented at any arbitrary angle with respect thereto, as long as the slit 68 intersects the selected air passages.

One advantage of the present invention resides in the fact that it can be applied to new components as well as existing components. Indeed, the stress-relief slits 68 can be formed in the nozzle head at the manufacturing stage thereof or even in an existing nozzle head which already presents some cracking. The addition of stress relief slits to a cracked piece will not repair the cracks but will significantly delay the propagation thereof to an unacceptable level.

The present invention is particularly interesting as a recondition technique in that it can be retrofitted to an existing nozzle part with minimal cost while extending its service life by a factor of 2 to 3 times.

Although the present invention has been described in the context of an airblast fuel nozzle, it is understood that the features of the present invention could be applied to other aerodynamic air flow surfaces which are prone to low cycle fatigue cracking due to thermal stresses. For instance, the present invention could be applied to air assisted nozzles or other types of fuel injectors which use this method of aeration.

What is claimed is:

1. A fuel nozzle for a combustor in a gas turbine engine, the fuel nozzle comprising a fuel nozzle body having a fuel inlet port at one end and a spray tip at the other end for atomizing the fuel, said spray tip including a nozzle head defining a plurality of air passages adapted to convey hot pressurized air into the combustor, each pair of adjacent air passages defining a web, said nozzle head having at least one stress-relief slit for reducing thermally-induced stresses in said webs during operation, and wherein said at least one stress-relief slit is formed in the outer periphery of the spray tip radially outwardly of said webs.

2. A fuel nozzle as defined in claim 1, wherein said at least one stress-relief slit is provided in the form of a straight cut through said one air passage.

3. A fuel nozzle as defined in claim 1, wherein said at least one stress-relief slit is substantially less than 0.006 inches wide.

4. A fuel nozzle as defined in claim 1, wherein said at least one stress-relief slit extends throughout the length of said one air passage.

5. A fuel nozzle as defined in claim 1, wherein said air passages are circumferentially spaced-apart, and wherein said at least one stress-relief slit extends outwardly of said array of air passages.

6. A fuel nozzle as defined in claim 1, wherein at least three stress-relief slits are defined through three different air passages, the three stress-relief slits being uniformly distributed about the array of air passages.

7. A gas turbine engine aerodynamic air flow surface prone to low cycle fatigue cracking due to thermal stress, the aerodynamic air flow surface defining at least one air passage having a length, said aerodynamic air flow surface having a prone cracking region where crack propagation is likely to take place, and wherein at least one stress-relief slit is defined in the aerodynamic air flow surface at a location remote from the prone cracking region.

8. A gas turbine engine aerodynamic air flow surface as defined in claim 7, wherein said at least one stress-relief slit intersects said at least one air passage and extends throughout the length thereof.

9. A gas turbine engine aerodynamic air flow surface as defined in claim 7, wherein said aerodynamic air flow surface includes a fuel nozzle spray tip, said fuel nozzle spray tip defining a pluralitry of air passages having first and second opposed axially spaced-apart ends, each pair of adjacent air passages defining a web, and wherein said at least one stress-relief slit is formed in the outer periphery of the fuel nozzle spray tip radially outwardly of said webs.

10. A fuel nozzle for a combuster in a gas turbine engine, comprising a fuel inlet port at one end and a spray tip at an opposed end for atomizing the fuel, said spray tip defining an array of air passages having longitudinally spaced-apart opposed ends, each pair of adjacent air passages defining a web which is prone to crack under thermal stress, and wherein thermally-induced stresses in said webs are relieved by at least one stress-relief slit defined in said spray tip remote from said webs.

11. A fuel nozzle as defined in claim 10, wherein said at least one stress-relief extends outwardly of said array of air passages.

12. A fuel nozzle as defined in claim 10, wherein said at least one stress-relief slit is formed in the outer periphery of the spray tip radially outwardly of said webs.

13. A fuel nozzle as defined in claim 10, wherein said at least one stress-relief slit intersects a selected one of said air passages along at least a portion of a length thereof.

* * * * *